US006932160B2

(12) United States Patent
Murray et al.

(10) Patent No.: US 6,932,160 B2
(45) Date of Patent: Aug. 23, 2005

(54) RISER PIPE GAS SEPARATOR FOR WELL PUMP

(75) Inventors: Rick G. Murray, Cochrane (CA); Michael J. Fox, Claremore, OK (US); Brown Lyle Wilson, Tulsa, OK (US); Donn J. Brown, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 80 days.

(21) Appl. No.: 10/447,122

(22) Filed: May 28, 2003

(65) Prior Publication Data

US 2004/0238179 A1 Dec. 2, 2004

(51) Int. Cl.[7] ..... E21B 43/17

(52) U.S. Cl. ..... 166/369; 166/313; 166/105.5; 166/265

(58) Field of Search ..... 166/369, 765, 166/313, 105.5, 105.6, 106

(56) References Cited

U.S. PATENT DOCUMENTS

| | | | | | |
|---|---|---|---|---|---|
| 1,578,720 | A | | 3/1926 | Derby | |
| 2,525,233 | A | * | 10/1950 | Miller | 166/105.5 |
| 2,587,333 | A | * | 2/1952 | Kelly | 166/191 |
| 2,748,719 | A | * | 6/1956 | Wells | 166/105.5 |
| 2,883,940 | A | * | 4/1959 | Gibson | 166/105.5 |
| 3,735,815 | A | * | 5/1973 | Myers | 166/313 |
| 4,354,554 | A | * | 10/1982 | Calhoun et al. | 166/321 |
| 4,676,308 | A | * | 6/1987 | Chow et al. | 166/369 |
| 5,431,228 | A | | 7/1995 | Weingarten et al. | |
| 5,482,117 | A | | 1/1996 | Kolpak et al. | |
| 5,570,744 | A | | 11/1996 | Weingarten et al. | |
| 5,845,709 | A | | 12/1998 | Mack et al. | |
| 6,066,193 | A | | 5/2000 | Lee | |
| 6,135,210 | A | | 10/2000 | Rivas | |
| 6,179,056 | B1 | * | 1/2001 | Smith | 166/313 |
| 6,216,788 | B1 | | 4/2001 | Wilson | |
| 6,322,616 | B1 | * | 11/2001 | Kennedy et al. | 96/208 |
| 2001/0004017 | A1 | | 6/2001 | Lopes | |
| 2002/0096327 | A1 | | 7/2002 | Kobylinski et al. | |

* cited by examiner

*Primary Examiner*—William Neuder
(74) *Attorney, Agent, or Firm*—Bracewell & Ginliani LLP

(57) ABSTRACT

A well pump has a riser gas separator for removing large slugs of gas prior to reentry into the pump. The riser extends upward from a barrier that is located in the well. The riser has an inlet that is located above an effective intake of the pump. Well fluid must turn to flow down to the pump, with gas separating by gravity flowing upward while the liquid flows downward. The downhole assembly has various configurations to assure that fluid flows past the motor for cooling.

40 Claims, 4 Drawing Sheets

RISER PIPE GAS SEPARATOR FOR WELL PUMP

FIELD OF THE INVENTION

This invention relates in general to submersible rotary well pump installations, and in particular to a riser pipe assembly for separating gas in the well fluid prior to entry in the pump intake.

BACKGROUND OF THE INVENTION

One category of well pump is an electrically driven rotary pump that is driven by a downhole electrical motor. These types of pumps operate best when pumping fluid that is primarily liquid. If the well fluid contains large quantities of gas, a gas separator can be connected to the pump assembly upstream of the pump for separating gas in the well fluid and discharging it into the casing. A common type of gas separator has rotatable vanes that separate the gas by centrifugal force.

While a gas separator works well enough to separate gas prior to the entry in the pump, another problem exists, particularly in horizontal wells where slugging is a problem. The term "gas slugging" refers to large gas bubbles that are encountered and which may require several minutes to dissipate through the pump or gas separator and into the casing. Normally, the motor of the pump is located below the pump and in a position so that well fluid flows over it for cooling the motor as the well fluid flows into the intake of the pump. If large gas bubbles are encountered, the motor could heat drastically during the interim that no liquid is flowing over it.

One solution is to place the motor within a shroud and locate the inlet of the shroud below the perforations. This requires the well fluid to flow downward from the perforations into the inlet of the shroud, then back up to the intake of the pump within the shroud. As the well fluid flows downward, some of the gas will separate from the well fluid and flow upward, reducing the amount of gas that flows into the shroud. While this works well enough in areas where a shroud intake can be placed below the perforations, in some cases, it is not possible to locate a shroud intake below the perforations.

SUMMARY OF THE INVENTION

In this invention, a rotary pump is suspended in the well on a string of tubing. The pump has an intake for receiving well fluid and a discharge for discharging well fluid into the tubing. An electrical motor is coupled to the pump for rotating the pump. A barrier locates in the well below the intake of the pump and blocks well fluid from flowing below the barrier directly to the intake of the pump. A riser has an inlet in communication with the lower side of the barrier and an outlet above an effective level of the intake of the pump for flowing well fluid from below the barrier to above the effective level of the intake of the pump. This causes liquid components of the well fluid to flow back downward to enter the intake of the pump. This also results in gravity separation of gas components of the well fluid, which flow upward around the tubing in the casing.

In one embodiment, the motor is suspended below the barrier, which is run with the assembly of the motor and the pump. The pump has a discharge tube that extends to a Y-tube at the lower end of the tubing. An axial leg of the Y-tube aligns with the riser to enable a wireline to be lowered through the tubing and through the riser to below the barrier.

In another embodiment, the motor is located above the barrier. A feedback tube extends from one of the pump stages for delivering well fluid to below the motor for cooling the motor.

In another embodiment, a shroud encloses the motor and the intake of the pump. The shroud has an intake that is above the barrier. A riser has an inlet in communication with the lower side of the barrier and an outlet above the intake of the shroud. During installation, the barrier and the riser are installed in the well first, then the pump and shroud are lowered to the well.

In a fourth embodiment, a shroud is employed as mentioned above. In this embodiment, however, only the barrier is installed first, the barrier having a polished bore receptacle. The shroud has a stinger on its lower end that stabs into the barrier when running the pump and motor. An adapter connected to the stinger has one passage that leads to the riser. The adapter has another passage that leads from an intake of the shroud to the exterior.

DETAILED DESCRIPTION OF THE PREFERRED EMBODIMENT

Figure 1:
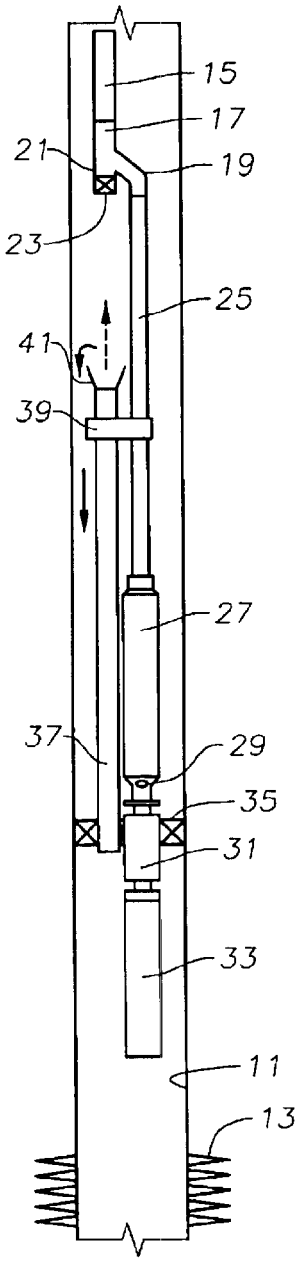
FIG. 1 is a schematic view illustrating a well pump installation having a riser pipe gas separator constructed in accordance with this invention.

Referring to FIG. 1, the well has a casing 11 containing a set of perforations 13 to allow the flow of formation fluid into casing 11. A string of production tubing 15 extends into the well. In this embodiment, a Y-tube 17 is secured to the lower end of tubing 15. Y-tube 17 has a single upper end, an offset lower leg 19 and an axial lower leg 21. Axial leg 21 is located coaxial with the axis of tubing 15. Axial leg 21 extends only a short distance and contains a wireline profile for receiving a wireline plug 23.

Offset leg 19 secures to a discharge tube 25 that extends upward from a rotary pump 27. Pump 27 is shown in this example to be a centrifugal pump having a large number of stages, each stage having an impeller and diffuser. Alternately, rotary pump 27 could be a progressive cavity pump, which has an elastomeric stator with a double-helical cavity therein. A rotor having a helical configuration rotates within the stator. Pump 27 has an intake 29 on its lower end.

An electrical motor assembly connects to the lower end of pump 27 to rotate pump 27. The motor assembly includes a seal section 31 and an electrical motor 33. Seal section 31 contains a thrust bearing for absorbing downward thrust from pump 27. Seal section 31 also equalizes pressure of lubricant contained in seal section 31 and motor 33 with the pressure of well bore fluid on the exterior.

A barrier 35 surrounds the upper portion of the motor assembly, particularly seal section 31 below intake 29. Barrier 35 seals to casing 11 and may be a variety of types. Because the pressure differential between the lower and upper side of barrier 35 is very low, barrier 35 may comprise simply an elastomeric swab cup that slidingly engages casing 11 as pump 27 is lowered into the well. Barrier 35 could also be an inflatable or expandable type of packer. Motor 33 and the majority of seal section 31 extend below barrier 35, terminating above perforations 13. The thrust bearing in seal section 31 is preferably located in the portion of seal section 31 that is above barrier 35.

A riser 37 extends sealingly through barrier 35 alongside seal section 31 and pump 27. Riser 37 has an upper end above intake 29 of pump 27. In the embodiment shown, the upper end of riser 37 is also above the upper end of pump 27. Riser 37 may comprise simply a hollow cylindrical pipe or it could be a conduit of a variety of cross-sectional dimensions and shapes. A brace 39 secures the upper portion of riser 37 to discharge tube 25 above pump 27. A funnel 41 optionally is located on the upper end of riser 37. Riser 37 is preferably in axial alignment with axial leg 21 of Y-tube 17.

All of the well fluid flowing from perforations 13 flows through riser 37. Riser 37 optionally may have structure that causes swirling of the well fluid to enhance separation of gas from liquid. The embodiment shown in FIGS. 2 and 3 has stationary, internal helical vanes 43 that extend continuously in a helical path in one section of riser 37. A single helix may form helical vanes 43, or they may comprise two separate vanes, as shown. Each helical vane 43 is parallel to the other, similar to a dual start thread. Each vane 43 is a short rib that is rigidly secured to the interior sidewall of riser 37 and protrudes a short distance inward, such as about ¼". The central area within riser 37 that is surrounded by helical vanes 43 is completely open to enhance the upward passage of gas. The liquid components move to the interior sidewall of riser 37 due to centrifugal force. The spacing between helical vanes 43 may be varied. Helical vanes 43 need not extend the full length of riser 37, rather preferably extend only the last two or three feet near the upper end of riser 37.

Also, preferably a plurality of apertures 45 are formed in the sidewall of riser 37 adjacent vanes 43. Apertures 45 allow some of the liquid to discharge out riser 37 as indicated by the arrows shown in FIG. 2. The remaining portions of the liquid flow out the open upper end of riser 37 with the gas. Apertures 45 are preferably located only in the upper portion of vanes 43.

Figure 2:
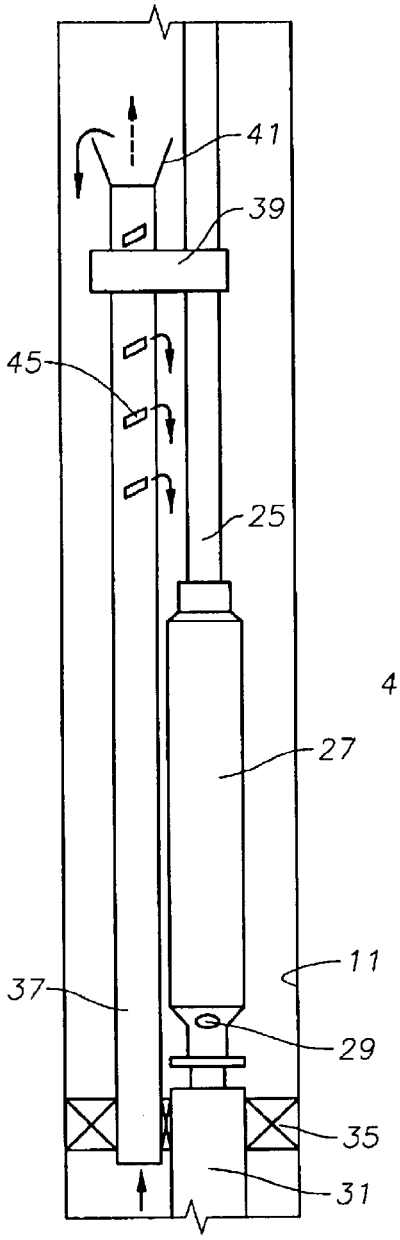
FIG. 2 is an enlarged view of a portion of the well pump installation of FIG. 1.
Figure 3:
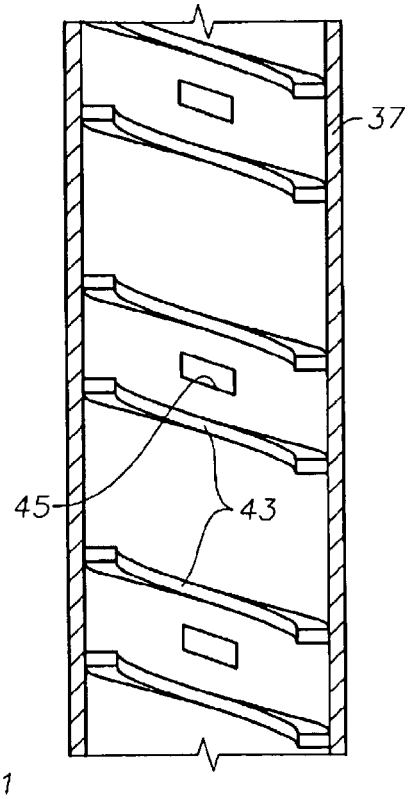
FIG. 3 is a sectional enlarged view of an upper portion of the riser of FIG. 1.

In the operation of the embodiment of FIGS. 1–3, pump 27, seal section 31, motor 33, barrier 35 and riser 37 are assembled together as shown, then lowered on tubing 15. The assembly is positioned with motor 33 located above perforations 13. Electrical power is supplied to motor 33, which rotates pump 27. Well fluid flows from perforations 13 around motor 33 and the lower portion of seal section 31 into the lower end of riser 37. The well fluid flows upward when it encounters helical vanes 43. The well fluid begins swirling, causing the liquid components to move to the interior sidewall of riser 37. Some of the liquid components will discharge out apertures 45. The gas remains in the open central area and flows out the upper end of riser 37 as indicated by the dotted arrow in FIG. 1. After leaving riser 37, the heavier liquid components flow downward by gravity into pump 27, as indicated by the solid arrows in FIG. 1. Pump 27 discharges the liquid components into tubing 15 for transport to the surface. If a large gas slug is encountered, it will flow over motor 33, then up riser 37 and into casing 11.

From time to time, it may be necessary to lower a wireline for various functions below barrier 35. If so, the operator lowers a retrieval tool into tubing 15 and retrieves wireline plug 23. The operator then lowers a wireline tool (not shown) down tubing 15, out axial leg 21 and into guide funnel 41. The wireline tool passes down riser 37 through the central open area surrounded by vanes 43. The wireline tool is free to pass below for performing various operations.

Figure 4:
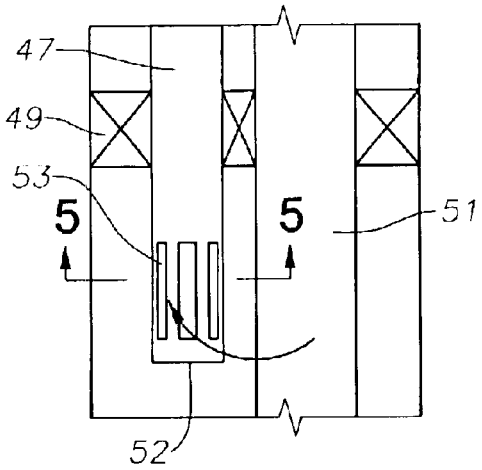
FIG. 4 is a schematic view of a lower portion of a second embodiment of a riser pipe gas separator.
Figure 5:
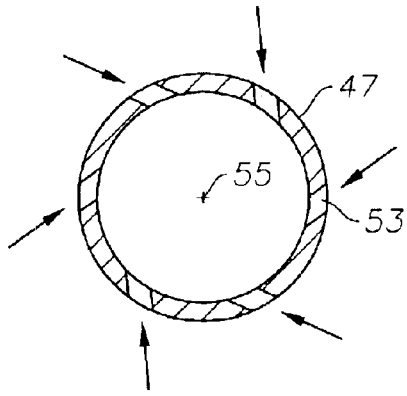
FIG. 5 is a sectional view of the riser of FIG. 4, taken along the line 5—5 of FIG. 4.

Turning to FIG. 4, this downhole assembly is the same as in FIG. 1, with the exception of riser 47. Riser 47 extends through barrier 49 alongside seal section 51. In this embodiment, however, riser 47 has a closed lower end 52, rather than open as in FIG. 1. The inlet to riser 47 comprises a plurality of slots 53 located in the sidewall of riser 47 near lower end 52. As shown in FIG. 5, each slot 53 is oblique or tangential. That is, slots 53 do not align radially with riser axis 55. Rather they intersect the radial lines of axis 55 at acute angles. As indicated by the arrows, slots 53 cause the well fluid to flow tangentially inward in a swirling motion around the interior of riser 47. Riser 47 may also have helical vanes 43 (FIG. 3) as in the first embodiment. Tangential slots 53 may be utilized in all of the embodiments of this application.

Figure 6:
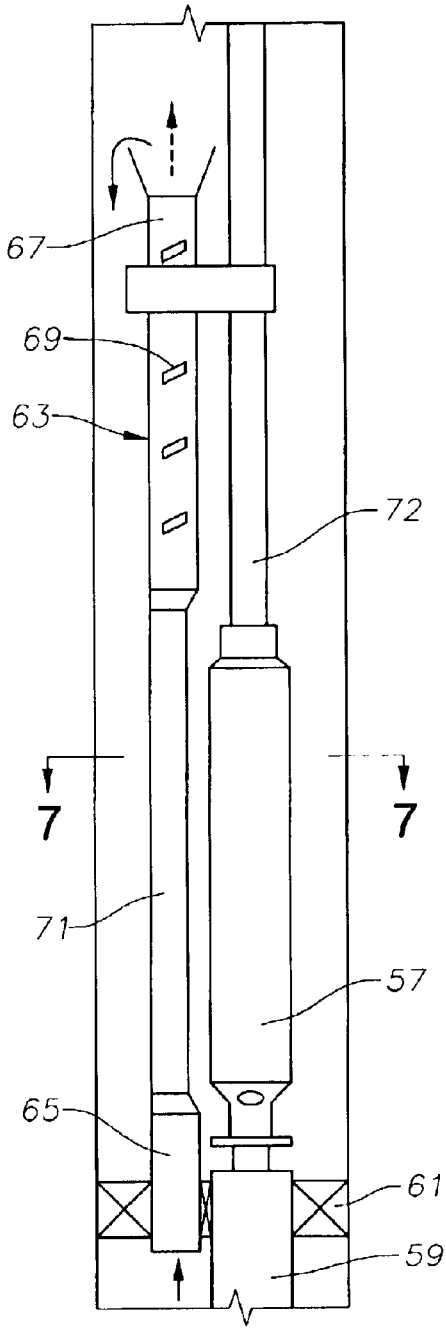
FIG. 6 is schematic view of a third embodiment of a riser gas separator for a well pump.

In the embodiment of FIG. 6, pump 57 and seal section 59 are installed in a barrier 61 as in the embodiment of FIG. 1. Riser 63 communicates from the lower side of barrier 61 to above pump 57 as in the first embodiment. However, in this embodiment, riser 63 has a different cross-sectional configuration than the cylindrical configuration of FIG. 2. Riser 63 has a lower section 65 that may be cylindrical or have a different configuration, but is shown to be cylindrical in this embodiment. Riser 63 has an upper section 67 that is preferably cylindrical. Upper section 67 may have helical vanes within it, such as vanes 43 of FIG. 3. Also, apertures 69 may be located along the helical vanes to discharge some of the liquid.

Figure 7:
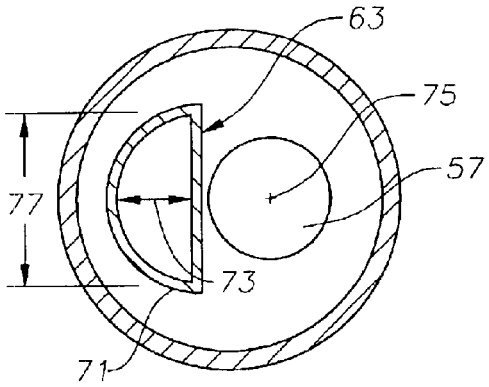
FIG. 7 is a sectional view of the riser of FIG. 6, taken along the line 7—7 of FIG. 6.

The intermediate section 71, however, which is the portion that extends alongside pump 57, is not cylindrical. Pump 57 has a larger diameter than its discharge tube 72, thus restricts the amount of space available within the well casing for intermediate section 71. Referring to FIG. 7, to provide the same flow area within intermediate section 71 as in lower section 65 and upper section 67, a non-cylindrical configuration is utilized. The configuration is shown in the shape of a "D", although it could be elliptical, oval, concave on one side and convex on the other, or other shape. Preferably, it has a minor axis or dimension and a major axis or dimension of different lengths. The minor axis 73 is located on a radial line of pump axis 75. Major axis 77 is perpendicular to the minor axis 73 and is substantially greater. This configuration more effectively utilizes the space in the well casing on the side of pump 75. The cross-sectional flow area through intermediate section 71 is preferably equal or greater than the cross-sectional flow areas in upper section 67 and lower section 65.

The entire riser 63 could be constructed with a non-cylindrical configuration as described but if helical vanes are utilized in upper section 67, a cylindrical configuration is preferred for upper section 67. The embodiment of FIG. 6 allows a cross-sectional flow area through riser 63 that would not be possible if the entire riser 63 were cylindrical because it would interfere with pump 57. The non cylindrical cross-sectional shape of intermediate portion 71 of riser 63 could be utilized in all of the embodiments of this application.

Figure 8:
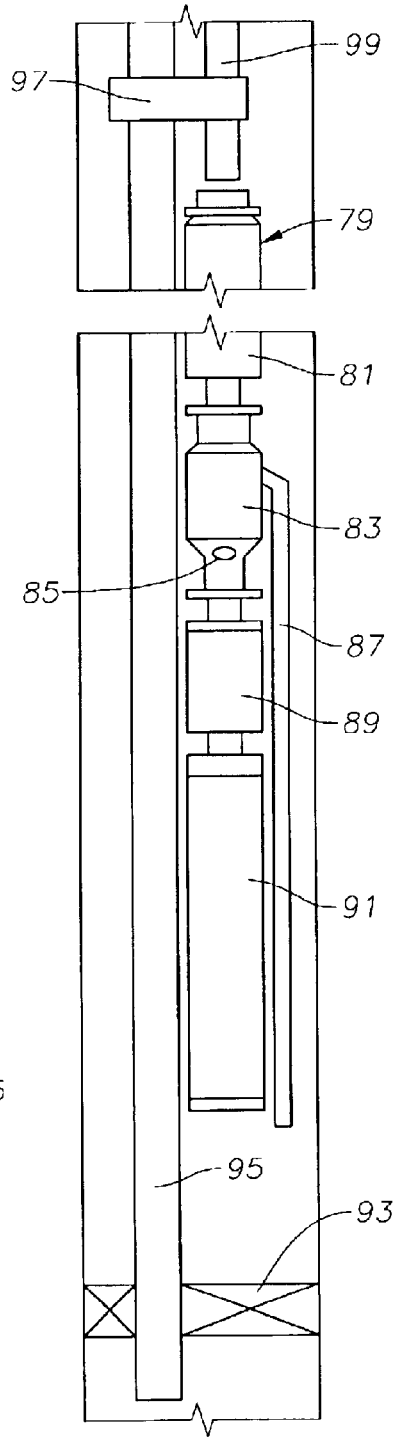
FIG. 8 is a schematic view of another embodiment of a riser gas separator for a well pump installation.

In the embodiment of FIG. 8, pump 79 is a centrifugal pump having a plurality of stages, each stage having an impeller and a diffuser. Pump 79 has an upper section 81 and a lower section 83. Lower section 83 has a few stages, while upper section 81 may have many stages more than lower section 83. Pump 79 has a single intake 85 that is located at the lower end of lower section 83. A feedback tube 87 taps into lower section 83 to cause some of the fluid being pumped up lower section 83 to be diverted back down feedback tube 87. Feedback tube 87 extends alongside seal section 89 and terminates below the lower end of motor 91. The pressure within pump 79 increases with each stage, beginning with the first stage in lower section 83.

In this embodiment, motor 91 is located above barrier 93, and feedback tube 87 is utilized to provide cooling liquid to flow over motor 91 during operation. Feedback tube 87 extends from one of the stages of lower section 83 to a point below motor 91. Riser 95 extends alongside motor 91, seal section 89 and pump 79 and has an open upper end above pump 79. A brace 97 secures the upper end of riser 95 to discharge tube 99 of pump 79.

In the operation of the embodiment of FIG. 8, barrier 93 and riser 95 are preferably run into the well along with pump 79 and motor 91. The operation is the same as described in connection with FIG. 1. All of the well fluid flows up riser 95. Gravity separation occurs at the upper end of riser 95 with the gas flowing upward alongside discharge pipe 99 while the liquid flows downward to pump intake 85. A portion of the well fluid will be discharged by feedback tube 87 below motor 91 to flow upward back into intake 85 for cooling of motor 91 and seal section 89. The pressure of the fluid flowing down feedback tube 87 will be much less than the discharge pressure from pump 79 because feedback tube 87 taps into pump 79 at a point in the first few stages.

Figure 9A:
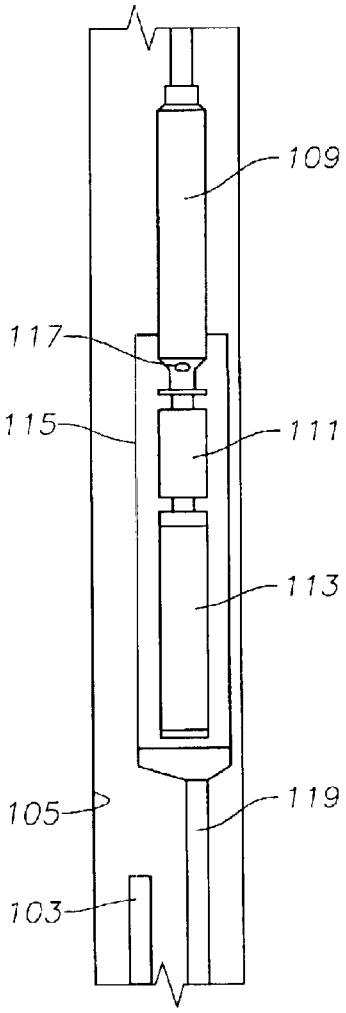
FIGS. 9A and 9B comprise a schematic view of another embodiment of a riser gas separator for a well pump installation.
Figure 9B:
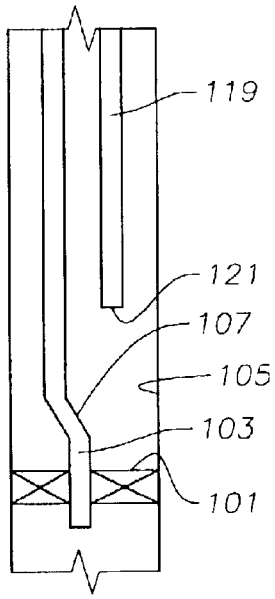

Referring to FIG. 9B, in this embodiment, barrier 101 may be a conventional packer that is set in a conventional manner. A riser 103 is lowered and set with barrier 101 in casing 105. Riser 103 has a lower end that is coaxial with barrier 101 and an offset section 107 that extends alongside pump 109.

After barrier 101 and riser 103 are installed, pump 109 is lowered through the well. Pump 109 has a seal section 111 and electrical motor 113 attached to its lower end. In this embodiment, a shroud 115 extends around seal section 111 and motor 113. The upper end of shroud 115 seals to the exterior of pump 109 above pump intake 117. Shroud 115 is a tubular enclosure that has a tail pipe 119 extending from its lower end. The inlet 121 or open lower end of tail pipe 119 defines the effective level of intake 117. The effective level is the elevation at which downward flowing well fluid turns to flow upward due to the suction of the pump. In this embodiment, the effective level is the elevation that fluid enters shroud 115, this level being below the upper end of riser 103. The effective level in the embodiments that do not employ a shroud, such as in FIG. 1, is the elevation of the actual intake 29 of the pump. In the embodiment of FIG. 9B, riser 103 need not and does not have its upper end located above the actual level of pump intake 117. However, the upper end of riser 103 is located above the effective intake 121 of pump 109.

In the operation of the embodiment of FIGS. 9A and 9B, barrier 101 and riser 103 are lowered into the well and set in a desired location above perforations (not shown). Pump 109, seal section 111, and motor 113, all encased in shroud 115, are lowered into the well. The operator lowers this assembly until the pump effective intake 121 is below the level of the outlet of riser 103.

In a well with a static fluid level above the discharge of riser 103, power is supplied to motor 113, which causes fluid to flow up the riser. Power is supplied to motor 113, which causes well fluid to flow up riser 103. Gas will flow from the outlet around shroud 115 into casing 105. Gravity will cause the liquid to flow downward from the outlet of riser 103 to pump effective intake 121. The liquid flows up through shroud 115 around motor 113 and seal section 111 into intake 117. As the well fluid flows past motor 113 and seal section 111, it cools each component.

Figure 10A:
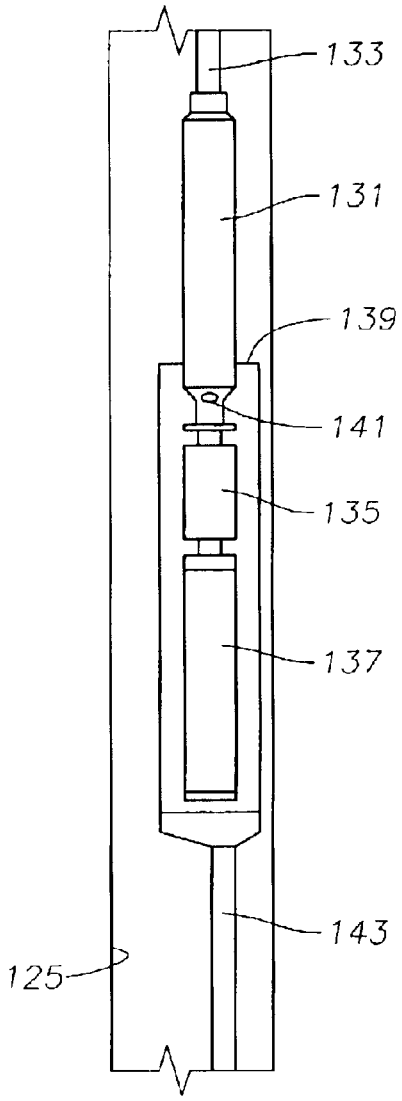
FIGS. 10A and 10B comprise a schematic view of another embodiment of a riser gas separator for a well pump installation.
Figure 10B:
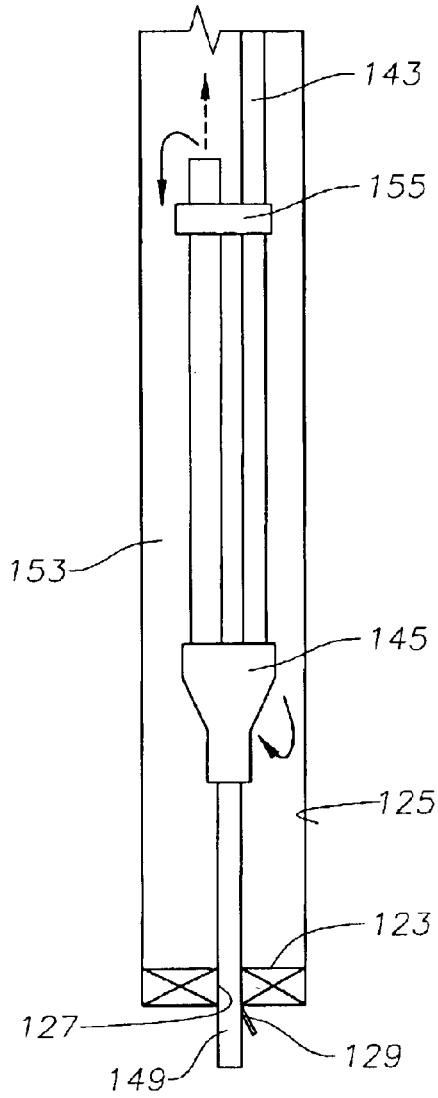

Referring to FIG. 10B, in this embodiment, barrier 123 may also comprise a conventional packer that is set in a conventional manner in casing 125. In this embodiment, barrier 123 has a polished bore receptacle 127 that has a flapper valve 129 on its lower end.

Pump 131 is secured to production tubing 133 and lowered into the well after barrier 123 is set. Pump 131 has a seal section 135 and a motor 137 suspended below it. A shroud 139 surrounds seal section 135 and motor 137 as well as pump intake 141. Shroud 139 has a tail pipe 143 that extends downward.

Figure 11:
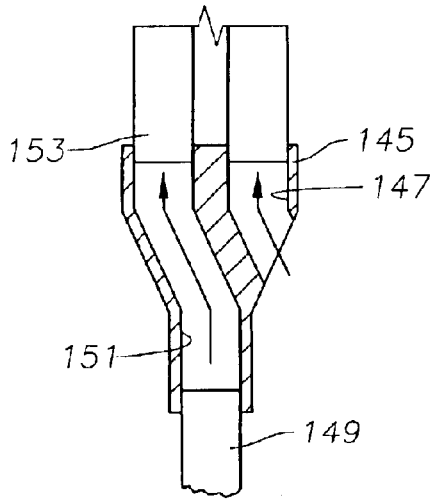
FIG. 11 is an enlarged schematic sectional view of the adapter of the riser gas separator of FIGS. 10A and 10B.

Referring to FIG. 11, tail pipe 143 secures to an adapter 145. Adapter 145 has a passage 147 that leads from the exterior to the interior of tail pipe 143 to deliver well fluid to the interior of shroud 139 (FIG. 10A). A stinger 149 extends downward from adapter 145 for insertion into polished bore 127 (FIG. 10B) and past flapper valve 129. Stinger 149 communicates with a passage 151 in adapter 145. Passage 151 leads upward to a riser 153. Riser 153 extends upward a selected distance, which in this case is below shroud 139. Riser 153 is secured to tail pipe 143 by a brace 155.

In this embodiment, the operator installs barrier 123 in a conventional manner. The operator then lowers the assembly shown in FIG. 10A into the well on tubing 133. Stinger 149 stabs into polished bore 127 and opens flapper valve 129. The operator supplies power to motor 137, causing well fluid to flow up stinger 149, passage 151, and riser 153. Gravity separation occurs with gas flowing upward in casing 125 and liquid flowing downward. The liquid flows downward to the effective intake of pump 131, which is the entrance of passage 147. This liquid flows up tail pipe 143 into shroud 139. The well fluid flows past motor 137 and seal section 135 into the actual intake 141 of pump 131.

The invention has significant advantages. The positioning of a riser above an effective intake of the pump allows a gravity separation to occur, causing gas to flow upward in the casing while liquid flows downward. The positioning of the assembly so that well fluid will flow past the motor enables cooling to occur. Consequently, if gas slugs encountered, the pump motor will not be exposed to a significant time period without liquid flow.

While the invention has been shown only in a few of its forms, it should be apparent to those skilled in the art that it is not so limited but susceptible to various changes without departing from the scope of the invention.

What is claimed is:

1. A well pump apparatus, comprising:

a rotary pump adapted to be suspended in a well on a string of tubing, the pump having an intake for receiving well fluid and a discharge for discharging well fluid into the tubing;

an electrical motor adapted to be supported by the string of tubing and operatively coupled to the pump for rotating the pump;

a barrier adapted to locate in the well below the intake of the pump and block well fluid from flowing from below the barrier directly to the intake of the pump; and a riser having an inlet in communication with a lower side of the barrier and having an outlet above an effective level of the intake of the pump for flowing well fluid from below the barrier to above the effective level of the intake of the pump, causing liquid components of the well fluid to flow back downward to enter the intake of the pump, and freeing gas components of the well fluid to flow upward around the tubing.

2. The apparatus according to claim 1, further comprising a brace extending from an upper portion of the riser for securing to the tubing above the pump.

3. The apparatus according to claim 1, further comprising a helical vane stationarily mounted in the riser for causing swirling of the well fluid flowing through the riser.

4. The apparatus according to claim 1, further comprising a helical vane mounted to an interior sidewall of the riser to encourage swirling flow of the well fluid, and wherein a central portion of the riser is free of any structure.

5. The apparatus according to claim 1, wherein the riser has a portion that extends alongside the pump, the portion having a horizontal cross sectional configuration that has a radial dimension measured on a radial line of an axis of the pump and a transverse dimension measured along a line perpendicular to the radial line, the transverse dimension being greater than the radial dimension.

6. The apparatus according to claim 1, wherein:

the riser has a central portion that extends alongside the pump, the central portion having a horizontal cross sectional configuration that has a minor axis and a major axis that is greater than the minor axis; and the riser has an upper portion that is cylindrical and contains a stationary helical vane for imparting swirling motion to the well fluid.

7. The apparatus according to claim 1, wherein the riser has a lower end that is closed, and the inlet comprises a plurality of slots formed in a sidewall of the riser, the slots extending through riser at angles relative to radial lines emanating from the axis of the riser so as to encourage swirling of the well fluid as it flows through the riser.

8. The apparatus according to claim 1, further comprising a helical vane stationarily mounted in the riser for imparting swirling motion to the well fluid; and at least one aperture in the sidewall of the riser adjacent the vane for allowing some of the liquid components to flow out of the riser.

9. The apparatus according to claim 1, further comprising:

a discharge tube extending upward from the pump;

a Y-tube having an upper end for connecting to the production tubing, an offset lower end that connects to the discharge tube, and an axial lower end that is axially aligned with the upper end of the Y-tube and also the outlet of the riser for passing a wireline tool from the production tubing through the riser; and a wireline profile in the axial lower end for receiving a retrievable wireline plug.

10. The apparatus according to claim 1, wherein the motor is located below the barrier.

11. The apparatus according to claim 1, wherein the pump is a centrifugal pump with a plurality of stages, and the apparatus further comprises:

a feedback tube extending from one of the stages downward below the motor for circulating some of the well fluid past the motor.

12. The apparatus according to claim 1, further comprising a shroud surrounding the motor and the intake of the pump, the shroud having an inlet on a lower end that defines the effective level of the intake of the pump and is above the barrier.

13. A well pump apparatus for installation in a well having a string of tubing suspended in casing, comprising:

a rotary pump adapted to be carried by the tubing, the pump having an intake for receiving well fluid and a discharge in communication with the tubing;

an electrical motor assembly operatively coupled to and below the pump for rotating the pump;

a barrier around an upper portion of the motor assembly for sealing to the casing in the well below the pump; and a riser having an inlet in communication with a lower side of the barrier and having an outlet above the intake of the pump for flowing well fluid from below the barrier to above the intake of the pump, causing liquid components of the well fluid to flow back downward to enter the intake of the pump and freeing gas components of the well fluid to flow upward around the tubing.

14. The apparatus according to claim 13, further comprising:

a discharge tube extending upward from the pump;

a Y-tube having an upper end for connecting to the production tubing, an offset lower end that connects to the discharge tube, and an axial lower end that is axially aligned with the upper end of the Y-tube and also the outlet of the riser for passing a wireline tool from the production tubing through the riser; and a wireline profile in the axial lower end for receiving a retrievable wireline plug.

15. The apparatus according to claim 13, wherein the barrier is mounted to the motor assembly, and the riser is cooperatively engaged with the tubing so that the motor assembly, the pump, the riser, and the barrier may be installed and retrieved as a unit.

16. A well pump apparatus for installation in a well having a string of tubing suspended in casing, comprising:

a centrifugal pump having a plurality of pump stages and adapted to be carried by the string of tubing, the pump having an intake for drawing well fluid and a discharge for discharging well fluid into the tubing;

an electrical motor operatively coupled to and below the pump for rotating the pump;

a barrier below the motor for sealing to the casing;

a riser having an inlet in communication with a lower side of the barrier and having an outlet above an intake of the pump for flowing well fluid from below the barrier to above the intake of the pump, causing liquid components of the well fluid to flow back downward to enter the intake of the pump and freeing gas components of the well fluid to flow upward in the casing; and a feedback tube in communication with one of the stages and extending back downward below the pump and above the barrier for discharging well fluid below the motor for cooling the motor.

17. The apparatus according to claim 16, further comprising:

a discharge tube extending upward from the pump;

a Y-tube having an upper end for connecting to the production tubing, an offset lower end that connects to the discharge tube, and an axial lower end that is axially aligned with the upper end of the Y-tube and also the outlet of the riser for passing a wireline tool from the production tubing through the riser; and a wireline profile in the axial lower end for receiving a retrievable wireline plug.

18. The apparatus according to claim 16, wherein the barrier is mounted to the motor, and the riser is cooperatively engaged with the tubing so that the barrier, the motor, the pump, and the riser may be installed and retrieved as a unit.

19. A well pump apparatus for installation in a well having a string of tubing suspended in casing, comprising:

a rotary pump adapted to be carried by the string of tubing, the pump having an intake for receiving well fluid and a discharge for discharging well fluid into the tubing;

an electrical motor assembly operatively coupled to and below the pump for rotating the pump;

a barrier below the motor for sealing to the casing;

a shroud enclosing the motor and the intake of the pump, the shroud having an inlet that is above the barrier; and a riser having an inlet in communication with a lower side of the barrier and having an outlet above the inlet of the shroud for flowing well fluid from below the barrier to above the inlet of the shroud, causing liquid components of the well fluid to flow back downward to enter the inlet of the shroud and freeing gas components of the well fluid to flow upward in the casing.

20. The apparatus according to claim 19, wherein the inlet of the shroud comprises a tube that extends alongside a portion of the riser.

21. The apparatus according to claim 19, wherein the riser and the barrier are secured together so as to be installed and retrieved as a unit, and the pump, the motor and the shroud are secured together and adapted to be installed and retrieved as a unit separately from the barrier and the riser.

22. The apparatus according to claim 19, wherein the riser, the barrier and the shroud are secured together so as to be installed and retrieved as a unit.

23. The apparatus according to claim 19, further comprising:

an adapter having a lower tubular member that joins to a passage in the barrier;

a first passage in the adapter that leads from the tubular member to a lower end of the riser; and a second passage in the adapter that leads from an exterior portion of the adapter above the barrier to the inlet of the shroud.

24. A well pump apparatus, comprising:

a rotary pump adapted to be suspended in a well on a string of tubing, the pump having an intake for receiving well fluid and a discharge for discharging well fluid into the tubing;

an electrical motor adapted to be supported by the string of tubing and operatively coupled to the pump for rotating the pump; and a gas separator with a discharge located above an effective level of the intake of the pump for separating gas from the well fluid prior to entry into the pump, the gas separator having an interior sidewall with a helical vane mounted thereto to impart swirling motion to the well fluid, and wherein a central portion of the gas separator is free of any structure.

25. The apparatus according to claim 24, wherein the gas separator has a lower end that is closed and an inlet that comprises a plurality of slots formed in the sidewall of the gas separator, the slots extending through sidewall at angles relative to radial lines emanating from the axis of the sidewall so as to impart swirling motion to the well fluid as it flows through the gas separator.

26. The apparatus according to claim 24, further comprising at least one aperture in the sidewall of the riser adjacent the vane for allowing some of the well fluid to flow out of the riser.

27. A method of pumping a well fluid containing gas and liquid from a well having a string of tubing suspended in casing, comprising:

(a) supporting a rotary pump and an electrical motor on the tubing;

(b) setting a barrier in the well below the pump;

(c) extending a riser upward from the barrier above an effective intake of the pump;

(d) rotating the pump with the electrical motor;

(e) flowing well fluid from below the barrier into the riser and discharging the well fluid from the riser at an elevation above the effective intake of the pump; and (f) causing the well fluid being discharged from the riser to flow downward toward the effective intake of the pump, thereby releasing some of the gas contained therein to flow upward in the casing while the remaining portion of the well fluid flows into the effective intake of the pump and is discharged by the pump into the tubing.

28. The method according to claim 27, wherein:

steps (a) and (b) further comprises positioning the electrical motor below the barrier.

29. The method according to claim 27, wherein step (b) further comprises:

mounting a helical vane stationarily within the riser; and step (e) further comprises imparting a swirling motion to the well fluid as it flows up the riser.

30. The method according to claim 29, wherein step (b) further comprises forming at least one aperture in the riser adjacent the helical vane, and step (e) further comprises flowing some of the well fluid out the aperture.

31. The method according to claim 27, wherein step (b) further comprises forming a plurality of oblique slots in a lower end of the riser, and step (e) further comprises causing the well fluid to flow through the slots generally tangential to the riser, thereby imparting swirling motion to the well fluid.

32. The method according to claim 27, wherein steps (a), (b) and (c) comprises lowering the barrier, the pump, the electrical motor, and the riser together as a unit into the casing with the tubing.

33. The method according to claim 27, wherein steps (a), (b) and (c) comprise lowering the barrier and the riser as a unit and setting the barrier in the casing, then lowering the pump and the electrical motor on the tubing into the well.

34. The method according to claim 27, wherein steps (a), (b) and (c) comprise setting the barrier in the casing, then lowering the pump, the electrical motor, and the riser as a unit into the well.

35. The method according to claim 27, wherein:

steps (a) and (b) comprises positioning the electrical motor above the barrier; and step (d) further comprises flowing well fluid over the electrical motor to cool the electrical motor.

36. The method according to claim 27, wherein:

step (a) further comprises enclosing the motor and an intake of the pump within a shroud, the shroud having an inlet that defines the effective intake of the pump;

step (b) comprises positioning the inlet of the shroud above the barrier.

37. A method of pumping well fluid that contains gas and liquid components from a well, comprising:

(a) connecting an electrical motor assembly to a lower end of a rotary pump, mounting a barrier around an upper portion of the motor assembly, and extending a riser upward from the barrier alongside the pump;

(b) securing the pump to a string of production tubing and lowering the pump, the motor assembly, the barrier, and the riser as a unit into the well;

(c) setting the barrier in the well with the barrier and the motor assembly above a set of perforations; and (d) supplying power to the motor to rotate the pump, which causes well fluid to flow from the perforations past the motor and up the riser, the well fluid then flowing back downward to the intake of the pump, freeing some of the gas to flow upward in the casing and the remaining portion of the well fluid to be discharged by the pump into the tubing.

38. The method according to claim 37, wherein step (b) comprises connecting an offset leg of a Y-tube between the tubing and a discharge tube of the pump, the Y-tube having an axial leg in axial alignment with the tubing and with the riser; and the method farther comprises lowering a wireline tool through the tubing, the axial leg of the Y-tube, and through the riser.

39. A method of pumping well fluid that contains gas and liquid components from a well, comprising:

(a) connecting an electrical motor assembly to a lower end of a rotary pump and enclosing the motor assembly and an intake of the pump in a shroud that has an inlet;

(b) installing a barrier in the well that has a riser extending upward therefrom;

(c) securing the pump to a string of production tubing and lowering the pump, the motor assembly, and the shroud into the well at a point where the inlet of the shroud is below an outlet of the riser; and (d) supplying power to the motor to rotate the pump, which causes well fluid to flow up the riser, the well fluid then flowing back downward to the inlet of the shroud, freeing some of the gas to flow upward in the casing and the remaining portion of the well fluid to be discharged by the pump into the tubing.

40. A method of pumping well fluid that contains gas and liquid components from a well, comprising:

(a) connecting an electrical motor assembly to a lower end of a rotary pump and enclosing the motor assembly and an intake of the pump in a shroud that has an inlet;

(b) mounting a riser assembly alongside the pump with an outlet of the riser assembly above the inlet of the shroud;

(c) installing a barrier in the well that has a receptacle;

(d) securing the pump to a string of production tubing and lowering the pump, the motor assembly, the shroud and the riser into the well as a unit and stabbing a lower end of the riser assembly into the receptacle; then (e) supplying power to the motor to rotate the pump, which causes well fluid to flow up the riser, the well fluid then flowing back downward to the inlet of the shroud, freeing some of the gas to flow upward in the casing and the remaining portion of the well fluid to be discharged by the pump into the tubing.

* * * * *